United States Patent [19]

Yamatsuta et al.

[11] Patent Number: 4,526,841

[45] Date of Patent: Jul. 2, 1985

[54] FIBER-REINFORCED METAL COMPOSITE MATERIAL

[75] Inventors: Kohji Yamatsuta, Osaka; Ken-ichi Nishio, Shiga, both of Japan

[73] Assignee: Sumitomo Chemical Company, Ltd., Osaka, Japan

[21] Appl. No.: 601,244

[22] Filed: Apr. 17, 1984

Related U.S. Application Data

[62] Division of Ser. No. 285,974, Jul. 23, 1981, Pat. No. 4,465,741.

[30] Foreign Application Priority Data

Jul. 31, 1980 [JP] Japan ..... 55-106154
Apr. 7, 1981 [JP] Japan ..... 56-52616
Apr. 7, 1981 [JP] Japan ..... 56-52617

[51] Int. Cl.[3] ..... B32B 15/20; B32D 19/02

[52] U.S. Cl. ..... 428/614; 428/654; 264/63; 420/590; 228/193; 432/1; 164/418; 204/14.1

[58] Field of Search ..... 428/614, 654; 420/590

[56] References Cited

U.S. PATENT DOCUMENTS 4,101,615 7/1978 Horikiri et al. ..... 264/63
4,241,148 12/1980 Schoer et al. ..... 428/654
4,444,603 4/1984 Yamatsuta ..... 428/614

FOREIGN PATENT DOCUMENTS 1506476 4/1978 United Kingdom .

*Primary Examiner*—Veronica O'Keefe
*Attorney, Agent, or Firm*—Birch, Stewart, Kolasch & Birch

[57] ABSTRACT

A fiber-reinforced metal composite material comprising a metal or alloy as the matrix and an inorganic fiber as the reinforcing material, characterized in that at least one element selected from the group consisting of tin, cadmium and antimony in the form of simple substance or organic or inorganic compound is incorporated into the matrix metal in an amount of 0.0005 to 10% by weight (calculated in terms of the element) so as to enhance the mechanical strength of the composite material.

13 Claims, No Drawings

FIBER-REINFORCED METAL COMPOSITE MATERIAL

This application is a divisional of copending application Ser. No. 285,974, filed on July 23, 1981, now U.S. Pat. No. 4,465,741.

The present invention relates to fiber-reinforced metal composite materials (hereinafter referred to as "composite materials") having an excellent mechanical strength which comprise an inorganic fiber as the reinforcing material and a metal or alloy as the matrix (hereinafter referred to as "matrix metal").

Recently, novel composite materials comprising an inorganic fiber (e.g. an alumina fiber, a carbon fiber, a silica fiber, a silicon carbide fiber, a boron fiber) as the reinforcing material and a metal (e.g. aluminum, magnesium, copper, nickel, titanium) as the matrix have been developed and begun to be used in many industrial fields.

In combining an inorganic fiber with a metal, a reaction is caused at the interface between the matrix metal which is melted or maintained at a high temperature and the inorganic fiber to create a weakened layer so that the strength of the resultant composite material is, in many cases lower than the theoretical value. For example, commercially available carbon fibers usually possess a strength of about 300 kg/mm$^2$, and the theoretical strength of a carbon fiber-reinforced composite material is calculated to be about 150 kg/mm$^2$ according to the rule of mixture, the content of fiber being assumed to be 50% by volume, even when the strength of the matrix material is neglected. In fact, a carbon fiber-reinforced epoxy resin composite material shows a strength of 150 kg/mm$^2$ or larger, while the strength of a carbon fiber-reinforced metal composite obtained by the liquid metal infiltration method using aluminum as the matrix is only about 30–40 kg/mm$^2$ at a maximum. This is due to deterioration of the fiber caused by an interfacial reaction between the fiber and the melted metal as mentioned above.

For prevention of the above deterioration of fibers, various methods are adopted, including treatment of the fiber surface with a coating agent. In Japanese Patent Publication (unexamined) No. 30407/1978, for example, there is disclosed a procedure in which the surface of silicon carbide fiber is protected with metals or ceramics forming a compound being inactive or stable to carbon and then the fiber is combined with a matrix metal. Though this method is effective for a silicon carbide fiber, a sufficient result is not obtained for other inorganic fibers, and there is a problem of troublesome handling. Japanese Patent Publication (unexamined) No. 70116/1976 describes that the mechanical strength of a fiber-reinforced metal composite material is increased by addition of lithium in an amount of several percents to an aluminum matrix. However, this method is effective only in cases where the inorganic fiber is not compatible or does not react with the matrix metal. In the case where the inorganic fiber reacts with the matrix metal and its deterioration is caused, a substantial effect is not obtained, but the mechanical strength tends to be rather lowered. Thus, a practically useful method for overcoming the above mentioned drawbacks is not yet established.

For the purpose of increasing the mechanical strength of a fiber-reinforced metal composite material, an extensive study has been made. As a result, it has been found that, by incorporation of at least one element selected from the group consisting of tin, cadmium and antimony into the matrix metal of the fiber-reinforced metal composite material, the deterioration of the inorganic fiber due to its reaction with the matrix metal can be prevented, and the mechanical strength of the composite material comprising such matrix metal can be greatly increased. The present invention is based on this finding.

As the inorganic fiber to be used as the reinforcing material in the invention, there may be exemplified a carbon fiber, a silica fiber, a silicon carbide fiber containing free carbon, a boron fiber, an alumina fiber, etc. Among them, the alumina fiber described in Japanese Patent Publication (examined) No. 13768/1976 can afford the most notable metal-reinforcing effect.

This alumina fiber is obtained by admixing a polyaluminoxane having structural units of the formula:

$$-\underset{\underset{Y}{|}}{Al}-O-$$

wherein Y is at least one of an organic residue, a halogen atom and a hydroxyl group with at least one compound containing silicon in such an amount that the silica content of the alumina fiber obtained is 28% or less, spinning the resultant mixture and subjecting the obtained precursor fiber to calcination. Particularly preferred is the alumina fiber which has a silica content of 2 to 25% by weight and which does not materially show the reflection of $\alpha$-$Al_2O_3$ in the X-ray structural analysis. The alumina fiber may contain one or more refractory compounds such as oxides of lithium, beryllium, boron, sodium, magnesium, silicon, phosphorus, potassium, calcium, titanium, chromium, manganese, yttrium, zirconium, lanthanum, tungsten and barium in such an amount that the effect of the invention is not substantially reduced.

The content of the inorganic fiber in the composite material of the invention is not particularly limited. Preferably, it may be from 15 to 70% by volume. When it is less than 15% by volume, the reinforcing effect is insufficient. When the volume is more than 70%, the strength is rather decreased due to the contact between fiber elements. The shape of the fiber may be long or short, and depending on the purpose or the use, there may be employed either a long fiber, a short fiber or both in combination. For obtaining the desired mechanical strength or modulus of elasticity, a suitable orienting method such as unidirection ply, cross ply or random orientation ply may be selected.

As the matrix metal, aluminum, magnesium, copper, nickel, titanium, etc. may be employed. Alloys of these metals are also usable. In the case where a light weight and a high mechanical strength are required, the system containing as the matrix aluminum, magnesium or their alloy is desirable. When a thermal resistance and a high strength are required, the system containing nickel or titanium as the matrix is favorable. These metals may contain a small amount of impurities insofar as they can be used in an ordinary way without trouble.

The characteristic feature of the present invention is that at least one element selected from the group consisting of tin, cadmium and antimony is incorporated in the matrix metal, whereby the mechanical strength of the resulting fiber-reinforced metal composite material is greatly increased. The mechanism for such increase of the mechanical strength is still unclear but may be assumed as follows.

When the said element is added to the matrix metal, the concentration of such element at the surface of the matrix metal becomes higher than the average concentration. In case of aluminum, for example, addition of tin, cadmium or antimony in an amount of 0.1 mol % decreases the surface tension of aluminum by 40, 15 or 105 dyn/cm, respectively, in comparison with the surface tension of pure aluminum. This is attributable to the fact that the concentration of the element at the surface portion is higher than the average concentration in the matrix as shown by the Gibbs' adsorption isotherm. The above fact has been actually confirmed by the aid of Auger's scanning microscope and EPMA (Electron Probe Micro Analyser).

Observation with a scanning electron microscope of the broken surface of an inorganic fiber-reinforced metal composite material, prepared from a matrix metal containing the said element, reveals that the bonding strength of the fiber-matrix interface in the fiber-reinforced metal complex material is weaker than that in the fiber-reinforced metal composite material not containing the said element. Furthermore, reaction phase with the matrix metal having been observed at the extraperipheral surface of the fiber disappears, whereby it is understood that the reaction at the fiber-matrix interface is diminished. When the composite material is treated with an aqueous hydrochloric acid solution to remove the matrix metal and the recovered fiber is subjected to determination of the tensile strength, a considerable decrease of the tensile strength is observed in the system not containing said element, compared with the strength of the fiber before use. In the system containing said element, any material decrease of the tensile strength of the fiber is not observed. Namely, the said element is present in a high concentration at the fiber-matrix interface and controls the reaction between the fiber and the matrix at the interface so that the mechanical strength of the composite material is greatly increased.

The incorporation of the said element into the matrix metal may be effected by adding the simple substance or compound of the element to the matrix metal. The addition of the element may be accomplished by a conventional procedure usually adopted for preparation of alloys. For example, the matrix metal is melted in a crucible in air or in an inactive atmosphere, and after the element in the form of simple substance or compound is added thereto, the mixture is stirred well and cooled. In some cases, the matrix metal in a powdery state may be admixed with the inorganic or organic compound of the element in a powdery state. It is surprising that the element in the form of a compound can afford similar effects as the one in the form of a simple substance. The use of the element in the form of compound is particularly advantageous when its simple substance is chemically unstable and can be handled only with great difficulty. As the inorganic and organic compounds of the element, there may be exemplified halides, hydrides, oxides, hydroxides, sulfonates, nitrates, carbonates, chlorates, carbides, nitrides, phosphates, sulfides, phosphides, alkyl compounds, organic acid compounds, alcoholates, etc.

The amount of the element in the form of a simple substance or of a compound to be incorporated may be usually from 0.0005 to 10% by weight (in terms of the element) to the weight of the matrix metal. When the amount is less than 0.0005% by weight, the technical effect is insufficient. When the amount is larger than 10% by weight, the characteristic properties of the matrix metal are deteriorated to cause decrease of corrosion-resistance, reduction of elongation, etc.

The preparation of the composite material of the invention may be effected by various procedures such as liquid phase methods (e.g. liquid-metal infiltration method), solid phase methods (e.g. diffusion bonding), powdery metallurgy (sintering, welding), precipitation methods (e.g. melt spraying, electrodeposition, evaporation), plastic processing methods (e.g. extrusion, compression rolling) and squeeze casting method. Among these procedures, particularly preferred are the liquid-metal infiltration method and the squeeze casting method in which the melted metal is directly contacted with the fiber. A sufficient effect can be also obtained in other procedures mentioned above.

The thus prepared composite material shows a greatly increased mechanical strength in comparison with the system not containing the element of the invention. It is an extremely valuable merit of the invention that the preparation of this composite material can be realized in a conventional manner by the aid of usual equipments without any alteration.

The present invention will be hereinafter explained further in detail by the following Examples which are not intended to limit the scope of the invention.

EXAMPLE 1

In a crucible made of graphite, aluminum having a purity of 99.99% by weight was melted under heating up to 700° C. in an argon atmosphere. A designed amount of the element in the form of simple substance as shown in Table 1 was added thereto, and the mixture was stirred well and cooled to obtain a matrix alloy.

As the inorganic fiber, the following substances were employed: (1) alumina fiber having an average fiber diameter of 14 μm, a tensile strength of 150 kg/mm$^2$ and a Young's modulus of elasticity of 23,500 kg/mm$^2$ ($Al_2O_3$ content, 85% by weight; $SiO_2$ content, 15% by weight); (2) carbon fiber having an average fiber diameter of 7.5 μm, a tensile strength of 300 kg/mm$^2$ and a Young's modulus of elasticity of 23,000 kg/mm$^2$; (3) free carbon-containing silicon carbide fiber having an average fiber diameter of 15 μm, a tensile strength of 220 kg/mm$^2$ and a Young's modulus of elasticity of 20,000 kg/mm$^2$; (4) silica fiber having an average fiber diameter of 9 μm, a tensile strength of 600 kg/mm$^2$ and a Young's modulus of elasticity of 7,400 kg/mm$^2$; and (5) boron fiber having an average fiber diameter of 140 μm, a tensile strength of 310 kg/mm$^2$ and a Young's modulus of elasticity of 38,000 kg/mm$^2$. Said inorganic fiber was introduced in parallel into a casting tube having an inner diameter of 4 mmϕ. Then, the above obtained alloy was melted at 700° C. in an argon atmosphere, and one end of the casting tube was immersed therein. While the other end of the tube was degrassed in vacuum, a pressure of 50 kg/cm$^2$ was applied onto the surface of the melted alloy, whereby the melted alloy was infiltrated into the fiber. This composite material was cooled to complete the combination. The fiber content of the complex material was regulated to become 50±1% by volume.

For comparison, a fiber-reinforced metal composite material comprising pure aluminum (purity, 99.99% by weight) as the matrix was prepared by the same procedure as above. The thus obtained fiber-reinforced metal composite materials were subjected to determination of flexural strength and flexural modulus. The results are shown in Table 1. In all of the composite materials comprising the alloy matrix, the strength was greatly increased in comparison with the composite materials comprising the pure aluminum matrix.

TABLE 1

| | Run No. | Inorganic fiber | Element added Kind | Element added Amount (% by wt.) | Flexural strength (kg/mm²) | Flexural modulus (kg/mm²) |
|---|---|---|---|---|---|---|
| Example | 1 | Alumina fiber | Tin | 0.006 | 78.3 | 12400 |
| | 2 | Alumina fiber | Tin | 0.14 | 90.1 | 12000 |
| | 3 | Alumina fiber | Tin | 1.12 | 95.4 | 11800 |
| | 4 | Alumina fiber | Cadmium | 0.018 | 74.8 | 12800 |
| | 5 | Alumina fiber | Cadmium | 0.16 | 86.2 | 13700 |
| | 6 | Alumina fiber | Cadmium | 0.96 | 91.1 | 13800 |
| | 7 | Alumina fiber | Antimony | 0.026 | 75.3 | 12600 |
| | 8 | Alumina fiber | Antimony | 0.20 | 86.7 | 12900 |
| | 9 | Alumina fiber | Antimony | 1.08 | 88.5 | 12900 |
| | 10 | Carbon fiber | Antimony | 1.05 | 52.8 | 13100 |
| | 11 | Silicon carbide fiber | Tin | 0.97 | 63.3 | 12000 |
| | 12 | Silica fiber | Cadmium | 0.94 | 42.2 | 7600 |
| | 13 | Boron fiber | Antimony | 0.96 | 55.1 | 18500 |
| Comparative Example | 14 | Alumina fiber | — | — | 70.0 | 12600 |
| | 15 | Carbon fiber | — | — | 43.0 | 13000 |
| | 16 | Silicon carbide fiber | — | — | 32.5 | 12100 |
| | 17 | Silica fiber | — | — | 31.1 | 7300 |
| | 18 | Boron fiber | — | — | 35.1 | 18200 |

EXAMPLE 2

In a crucible made of graphite, aluminum having a purity of 99.99% by weight was melted under heating up to 700° C. in an argon atmosphere. A designed amount of the element in the form of compound as shown in Table 2 was added thereto, and the mixture was stirred well and then cooled to obtain a matrix alloy.

As the inorganic fibers, the same alumina fiber, carbon fiber and silicon carbide fiber as used in Example 1 were employed, and the same procedure as in Example 1 was used to obtain fiber-reinforced composite metal materials. The fiber content of the composite material was regulated to become 50±1% by volume.

The thus prepared fiber-reinforced metal composite materials were subjected to determination of flexural strength at room temperature. The results are shown in Table 2. All of the composite materials produced the marked increase of the mechanical strength in comparison with Comparative Example as shown in Table 1.

TABLE 2

| | Run No. | Inorganic fiber | Element added Kind | Element added Amount (% by wt.) | Flexural strength (kg/mm²) |
|---|---|---|---|---|---|
| Example | 19 | Alumina fiber | Stannic oxide | 1.02 | 87.9 |
| | 20 | Alumina fiber | Antimony oxide | 0.95 | 80.4 |
| | 21 | Alumina fiber | Cadmium chloride | 0.97 | 82.4 |
| | 22 | Alumina fiber | Cadmium acetate | 0.50 | 75.8 |
| | 23 | Alumina fiber | Tin formate | 0.88 | 78.2 |
| | 24 | Carbon fiber | Stannic oxide | 1.52 | 56.0 |
| | 25 | Slilcon carbide fiber | Cadmium chloride | 1.26 | 61.3 |

EXAMPLE 3

In this example, magnesium, copper or nickel is employed as the matrix metal.

In case of magnesium, commercially available pure magnesium (purity, 99.9% by weight) was melted under heating up to 700° C. in an argon atmosphere in a crucible made of graphite. A designed amount of the element in the form of simple substance as shown in Table 3 was added thereto, and the mixture was stirred well and cooled to obtain a matrix alloy, which was then combined with the same alumina fiber as used in Example 1 by the same procedure as in Example 1 to obtain a fiber-reinforced metal composite material. For comparison, a composite material comprising pure magnesium as the matrix was prepared by the same procedure as above. The fiber content of the composite material was regulated to become 50±1% by volume.

In case of copper, the same alumina fiber as in Example 1 was immersed into a dispersion obtained by dispersing copper powder (300 mesh pass) (98.0 g) and antimony powder (300 mesh pass) (2.0 g) in a solution of polymethyl methacrylate in chloroform to prepare an alumina fiber sheet whose surface was coated with powdery copper and antimony. The sheet had a thickness of about 250μ and a fiber content of 56.7% by volume. Ten of the sheets were piled and charged into a carbon-made casting tool, which was placed into a vacuum hot press and heated at 450° C. with a vacuum degree of $10^{-2}$ Torr to decompose polymethyl methacrylate as the sizing agent. The pressure and the temperature were gradually elevated, and the final condition of $10^{-3}$ Torr, 650° C. and 400 kg/mm² was kept for 20 minutes to obtain a fiber-reinforced metal composite material. For comparison, a fiber-reinforced metal composite material comprising copper alone as the matrix was prepared by the same procedure as above.

In case of nickel, the same alumina fiber as used in Example 1 was immersed into a dispersion obtained by dispersing Ni-2.0% by weight Sn alloy powder in a solution of polymethyl methacrylate in chloroform to prepare an alumina fiber sheet whose surface was coated with Ni-2.0% by weight Sn alloy powder. This sheet had a thickness of about 250μ and a fiber content of 56.1% by volume. Ten of the sheets were piled and charged into a carbon-made casting tool, which was placed into a vacuum hot press and heated at 450° C. for 2 hours with a vacuum degree of $10^{-2}$ Torr to decompose polymethyl methacrylate as the sizing agent. The pressure and the temperature were then gradually elevated, and the final condition of $10^{-3}$ Torr, 900° C. and 400 kg/mm$^2$ was kept for 30 minutes to obtain a fiber-reinforced metal composite material. For comparison, a fiber-reinforced metal composite material comprising Ni alone as the matrix was prepared by the same procedure as above.

These composite materials were subjected to determination of flexural strength at room temperature. The results are shown in Table 3. All of the composite materials produced the great increase of the strength in comparison with Comparative Example as shown therein.

TABLE 3

| | Run No. | Matrix metal | Flexural strength (kg/mm$^2$) |
|---|---|---|---|
| Example | 26 | Mg-1.05% Sn | 52.4 |
| | 27 | Mg-1.02% Cd | 48.7 |
| | 28 | Mg-0.99% Sb | 50.9 |
| | 29 | Cu-2.0% Sb | 59.0 |
| | 30 | Ni-2.0% Sn | 62.1 |
| Comparative Example | 31 | Mg | 40.3 |
| | 32 | Cu | 47.8 |
| | 33 | Ni | 53.8 |

What is claimed is:

1. A method for preparing a fiber-reinforced metal composite material comprising:

incorporating into a metal or alloy matrix at least one element selected from the group consisting of tin, cadmium and antimony in an amount of 0.0005 to 10% by weight; and contacting the thus prepared matrix containing said element with an inorganic fiber reinforcing material to form the fiber-reinforced metal composite material.

2. The method according to claim 1, wherein said element is incorporated into said metal or alloy matrix by adding the element to a melt of the metal or alloy matrix.

3. The method according to claim 1, wherein said element is incorporated into said metal or alloy matrix by admixing a powder of said element with a powder of said metal or alloy matrix.

4. The method according to claim 1, wherein said inorganic fiber contacting step is performed by liquid-metal infiltration, diffusion bonding, sintering, welding, melt spraying, electrodeposition, evaporation, extrusion, compression rolling or squeeze casting.

5. The method according to claim 1, wherein said element is incorporated into said matrix in elemental form.

6. The method according to claim 1, wherein said element is incorporated into said matrix in the form of an inorganic or organic compound.

7. The method according to claim 1, wherein the inorganic fiber is a carbon fiber, a silicon fiber, a silicon carbide fiber, a boron fiber or an alumina fiber.

8. The method according to claim 1, wherein the metal or alloy is aluminum, magnesium, copper, nickel, titanium or alloys thereof.

9. A method for improving the mechanical strength of fiber-reinforced metal composite materials comprising an inorganic fiber as the reinforcing material and a metal or alloy as the matrix comprising incorporating into said matrix at least one element selected from the group consisting of tin, cadmium and antimony in an amount of 0.0005 to 10% by weight.

10. The method according to claim 9, wherein said element is added in elemental form to the metal or alloy.

11. The method according to claim 9, wherein said element is added as an inorganic or organic compound to the metal or alloy.

12. The method according to claim 9, wherein the inorganic fiber is a carbon fiber, a silica fiber, a silicon fiber, a boron fiber or an alumina fiber.

13. The method according to claim 9, wherein the metal or alloy is aluminum, magnesium, copper, nickel, titanium or alloys thereof.

* * * * *